US010062983B2

(12) United States Patent
Morimoto et al.

(10) Patent No.: US 10,062,983 B2
(45) Date of Patent: Aug. 28, 2018

(54) CONNECTOR

(71) Applicant: NSK Ltd., Tokyo (JP)

(72) Inventors: Masakazu Morimoto, Tokyo (JP); Tadayoshi Osakabe, Tokyo (JP); Osamu Miyoshi, Tokyo (JP)

(73) Assignee: NSK LTD., Tokyo (JP)

( * ) Notice: Subject to any disclaimer, the term of this patent is extended or adjusted under 35 U.S.C. 154(b) by 0 days.

(21) Appl. No.: 15/545,042

(22) PCT Filed: Feb. 5, 2016

(86) PCT No.: PCT/JP2016/053465
§ 371 (c)(1),
(2) Date: Jul. 20, 2017

(87) PCT Pub. No.: WO2016/125883
PCT Pub. Date: Aug. 11, 2016

(65) Prior Publication Data

US 2018/0019529 A1 Jan. 18, 2018

(30) Foreign Application Priority Data

Feb. 6, 2015 (JP) ..... 2015-022559

(51) Int. Cl.
*H01R 13/52* (2006.01)
*H01R 12/58* (2011.01)
(Continued)

(52) U.S. Cl.
CPC ..... *H01R 12/585* (2013.01); *H01R 9/223* (2013.01); *H01R 43/20* (2013.01)

(58) Field of Classification Search
CPC .. H01R 12/716; H01R 13/514; H01R 12/714; H01R 13/502; H01R 12/58; H01R 2201/26; H01R 9/226; H01R 9/223
See application file for complete search history.

(56) References Cited

U.S. PATENT DOCUMENTS 9,099,800 B2 * 8/2015 Morimoto ..... H01R 13/629
9,318,821 B2 * 4/2016 Sunaga ..... H01R 12/523

FOREIGN PATENT DOCUMENTS

JP 08-124622 A 5/1996
JP 09-232024 A 9/1997
(Continued)

OTHER PUBLICATIONS

International Search Report of PCT/JP2016/053465 dated Apr. 26, 2016 [PCT/ISA/210].

*Primary Examiner* — Xuong Chung Trans
(74) *Attorney, Agent, or Firm* — Sughrue Mion, PLLC

(57) ABSTRACT

A connector housing includes a hole having a minimum size that a lead section of a connector terminal to penetrate, and a guide wall which is formed along an outer peripheral of the hole, and is protruded in a direction which a lead section protrudes from the connector housing to a bending section of the lead section, wherein, by which inner walls of the guide wall is mutually and directly in contact with side surfaces of the lead section over a height near a top end side of the lead section in a bending section of the lead section from an outer peripheral of the hole, a sealing structure is formed from the bending section of the lead section to an interior of the connector housing.

18 Claims, 14 Drawing Sheets

(51) Int. Cl.
*H01R 43/20* (2006.01)
*H01R 9/22* (2006.01)

(56) References Cited

FOREIGN PATENT DOCUMENTS

| | | | |
|---|---|---|---|
| JP | 3113104 | U | 9/2005 |
| JP | 2006-140113 | A | 6/2006 |
| JP | 2012-134007 | A | 7/2012 |
| JP | 2013-206969 | A | 10/2013 |
| WO | 2014/073178 | A1 | 5/2014 |

* cited by examiner

CONNECTOR

CROSS REFERENCE TO RELATED APPLICATIONS

This application is a National Stage of International Application No. PCT/JP2016/053465, filed Feb. 5, 2016, claiming priority based on Japanese Patent Application No. 2015-022559, filed Feb. 6, 2015, the contents of all of which are incorporated herein by reference in their entirety.

TECHNICAL FIELD

The present invention relates to a connector that assembles a connector terminal into a connector housing by insertion-press fitting or the like, and in particular to the connector that supports a lead section from a side surface using a guide wall by bent a lead section of the connector terminal, and directly contacted the side surface of the bending lead section with the guide wall which is disposed on the connector housing by using a means of the insertion-press fitting or the like, improves sealing of a contact portion between the connector terminal and the connector housing, and prevents from entering a foreign matter or the like from a contact portion between the connector housing and the connector terminal to the connector housing.

BACKGROUND ART

Conventionally, as a substrate configuring an electronic control unit (ECU) and so on for a vehicle, a substrate that is incorporated in electronic devices is connected to electrical-conductive wirings or the like for a sensor signal and a supplying electricity from an external apparatus being connected to the substrate via a connector. The connection between such the connector and the substrate is performed by soldering an end portion of a lead section, which is provided on a connector terminal of the connector, to a land or the like of a through hole which is formed on the substrate. Connections of the electrical-conductive wirings from the external apparatus to the connector are performed by fitting connecting terminals from the external apparatus being engaged with the connector terminal in the housing of the connector.

As an example of such the connector, a technology described in, for example, Japanese Unexamined Patent Publication No. 2006-140113 A (Patent Document 1) is disclosed.

An object of the technology disclosed in Patent Document 1 is to ensure a soldering state between the connector terminal and the substrate and prevent a dew condensation at surroundings of the connector terminal.

Thus, in the technology disclosed in the Patent Document 1, dew condensation preventing walls are provided with a connector housing in order to shield a space between the substrate and the connector housing when the connector housing is connected from a plate surface of the substrate. The dew condensation preventing walls are intermittently provided with an outer peripheral of the connector, and then the soldering state can be visually checked among the dew condensation preventing walls.

As an example of another connector, a technology described in, for example, Japanese Unexamined Patent Publication No. 2012-134007 (Patent Document 2) is disclosed.

The technology disclosed in the Patent Document 2 relates to an electronic part embedded-connector. In a case that male terminal metal fittings are press-fitted and are inserted into terminal inserting holes of a holding member which is contained in a part containing room of the electronic part embedded-connector and then the part containing room is filled with mold material, an object of the technology of the Patent Document 2 is to prevent from inhibiting a terminal connection by leaking the mold material by means of a capillary phenomenon from spaces between the male terminal metal contacts and the terminal inserting holes In this connection, in the technology disclosed in the Patent Document 2, striking sections to which the abutting sections of the male terminals strike, are disposed into the terminal inserting holes of the holding member, creeping-distance increasing sections are provided with the striking sections and the abutting sections, and then leaking the molding material by means of the capillary phenomenon from the spaces is suppressed by increasing the creeping distance.

THE LIST OF PRIOR ART DOCUMENTS

Patent Documents

Patent Document 1: Japanese Unexamined Patent Publication No. 2006-140113 A

Patent Document 2: Japanese Unexamined Patent Publication No. 2012-134007 A

SUMMARY OF THE INVENTION

Problems to be Solved by the Invention

Now, in the connector being connected to the substrate described above, for the purpose of mitigation of a stress caused by a thermal contraction, a thermal expansion or the like for the substrate or a soldering portion, there is a case that the bending process is performed on the lead section of the connector terminal to be soldered onto the substrate in the substrate.

As one of methods which assemble the connector terminal, which such a bending process is performed, to the connector housing, an insert molding which integrally molds the terminal in molding the connector, is existed. However, in this method by the insert molding, since molding process is complicated, a cost generally increases.

Then, in order to avoid an increase in such a cost, the assembling by an outsert-molding which is another method to the above one is performed. However, if the bending process to the lead section of the connector terminal is performed after the outsert-molding, a crack occurs in the connector housing and a location precision of the terminal is deteriorated since a load is applied to a resin which constitutes the connector housing. Therefore, considering the above matters, preferably, at first the bending process to the lead section of the connector terminal is performed, and then the terminal is outsert-molded.

When the bending process to the lead section of the connector terminal is performed before the outsert, as methods that assemble the connector terminal to the connector housing by a press fitting, a normal method that inserts the connector terminal into the connector housing from a direction which the connection terminal from the external apparatus inserts into the connector, and a method that inserts the connector terminal from the substrate side which the direction of inserting the connection terminal from the external apparatus into the connector is different, are existed.

However, in a case that adopting the method that the press fitting direction to the connector housing of the connector terminal is from the substrate side, which is different from the normal method, because it is not necessary to perform the press fitting from a side of performing the bending process of the lead section, it is possible to assemble the connector terminal without enlargement of an opening of the connector housing. However, when the connection terminal from the external apparatus is inserted into the connector, there is a probability that a pulling out of the connector terminal occurs and the load to the substrate increases due to the load of insertion of the connection terminal into the connector.

On the other hand, in a case that the normal method which inserts the connector terminal into the connector housing from a same direction as the direction of inserting the connecting terminal from the external apparatus to the connector, it is necessary to provide an enlarged opening to pass the lead section which is performed the bending process for the connector housing. Consequently, since such an opening is enlarged, a space is formed between the lead section of the connector terminal and the opening of the connector housing after the assembling of the connector terminal. In this connection, there are problems that a foreign matter such as a dust may be entered, and an energization of the connector portion is badly affected.

To such problems, the technology described in the Patent Document 1 prevents from entering moisture by providing the walls on the connector housing. Because the connector terminal is not press-fitted into the connector housing and the connector terminal which the bending process is performed at the lead section is not supposed, a prevention of entering the foreign matter from the opening of the housing provided the connector terminal is not supposed as a technical problem.

Further, the technology described in the Patent Document 2 press-fits the connector terminal into the connector housing. However, the connector terminal which the bending process is performed at the lead section is not supposed, and the prevention of entering the foreign matter is not supposed as a technical problem as with the case of the Patent Document 1.

Then, the present invention is intended to resolve the above problems, and an object of the present invention is to provide a connector comprising a connector terminal having a lead section in which a bending process is performed, which is capable of realizing a simple assembling in a low cost and prevention of entering a foreign matter to the connector housing.

Means for Solving the Problems

In order to resolve the above problems, the present invention provides a connector comprising: a connector terminal having an insertion section including a terminal metal fitting to electrically connect to an external connecting terminal, and a lead section that has a first end fixed to an end portion of the insertion section, has a second end connected to a substrate, and has a bent shape; and a connector housing to hold the connector terminal, wherein the connector housing comprises: a through hole having a minimum size that the lead section to penetrate by inserting the connector terminal, which is provided with the lead section, from an insertion side of an external connecting terminal of the connector housing; and a guide wall which is formed along an outer peripheral of the through hole, and is protruded in a direction which the lead section protrudes from the connector housing, wherein the guide wall has a height near a top end side of the lead section in a bending section of the lead section from at least the outer peripheral of the through hole in a state that the connector housing holds the connector terminal, wherein in inner walls of the guide wall and side surfaces of the lead section, by which at least one surface of the inner walls of the guide wall is mutually and directly in contact with a side surface of the lead section and other two surfaces of the inner walls of the guide wall are mutually and directly in contact with the side surfaces of the lead section over a height near a top end side of the lead section in a bending section of the lead section, a sealing structure is formed from the bending section of the lead section to an interior of the connector housing.

The above-described object of the present invention is efficiently achieved by that: wherein a seal lip section is provided so as to stand from a peripheral of an opening of a top end portion of the guide wall, and sealing property is improved by being contacted an inner surface of the seal lip section with the side surface of the lead section; or wherein the connector housing includes a press fitting hole which the connector terminal is press-fitted, and the insertion section includes a press fitting section that press-fits the fixed end side of the lead section into the press fitting hole; or wherein the press fitting section includes minute protrusions which protrude from side end sections of the insertion section to side directions; or wherein the insertion section is provided adjacent to the press fitting section opposed to the fixed side of the lead section, and comprises stoppers which protrude from an outer peripheral of the press fitting hole to a side direction; or wherein the terminal metal fitting is a connecting terminal which is used for power-supply and has a flat plate shape; or wherein the lead section has a quadrangle cross-sectional shape, the top end portion of the lead section is coincident with an inserting direction to the connector housing of the connector terminal in a holding state to the connector housing, the lead section comprises two bending sections, has a substantially "Z"-shape and is extended to a position which is offset to a center position of the connector housing against a fixed point to the insertion section, and the guide wall is in contact with at least three side surface of the lead section whose cross-sectional shape is a quadrangle shape; or wherein the connector comprises a heat conductive resin.

Effects of the Invention

The present invention having the above configuration forms the sealing structure in the connector housing of the connector by which a space formed when the lead section penetrates from the insertion side to the substrate side via the through hole is sealed by the side surfaces of the lead section of the connector terminal by means of a direct contact with the inner walls of the through hole when the lead section of the connector terminal is bent and the side which is provided with the lead section of the connector terminal penetrates the through hole of the connector housing from the insertion side of the external connecting terminal of the connector housing.

Thus, it is possible to decrease the stress to the substrate and the soldering portion due to the thermal contraction and the thermal expansion by forming a bent shape of the lead section which is soldered to the substrate. When the connector terminal is assembled to the connector housing, it is possible to insert the connector terminal, which the lead section is a front end side, into the connector housing in an inserting connector direction, and to hold the connector terminal. Accordingly, it is possible to prevent the pulling out of the connector terminal due to the load when inserting the connector from the external connecting apparatus, and further to prevent the load to the substrate which is connected to the lead section.

Further, since the lead section of the connector terminal is previously bent and then is outsert-molded into the connector housing, as with a case of performing the bending process to the lead section after the outserting, it is possible to prevent from exerting the stress on the connector housing, suppress the occurrence of the crack of the connector and improve the location precision of the top end of the lead section.

In a state that the connector housing holds the connector terminal, since the guide wall has a distance from at least the outer peripheral of the through hole to a position near the top end side of the lead section in the bending section of the lead section, it is possible to protect the lead section which protrudes from the connector housing. Hence, it is possible to reinforce a bending load input against the lead section and to prevent the falling down of the lead section. Further, since the inner walls of the guide wall are directly in contact with the side surfaces of the lead section of the connector terminal and the sealing structure is formed, it is possible to seal the through hole formed on the connector housing against the substrate side with the inner walls of the guide wall and the side surfaces of the lead section. Thus, it is possible to prevent entering the foreign matter between the connector side and the substrate which is connected to the connector.

Furthermore, in the present invention, since the lead section of the connector terminal is directly in contact with the inner walls of side surfaces of the through hole, a heat transfer efficiency becomes higher due to a mutual contact. In this connection, by using the resin having a high heat conductivity to the connector, it is possible to more efficiently diverge heat from the connector terminal section via the connector housing.

BRIEF DESCRIPTION OF THE DRAWINGS

In the accompanying drawings:

FIG. 10A is a top view, FIG. 10B is a side view and FIG. 10C is a perspective view;

FIG. 11A is a diagram viewed a connector 50 from an insertion side, FIG. 11B is a cross-sectional view taken along a line A-A of FIG. 11A and FIG. 11C is a cross-sectional view taken along a line B-B of FIG. 11A;

FIG. 12A is a top view, FIG. 12B is a side view, FIG. 12C is a perspective view and FIG. 12D is a cross-sectional view taken along a line X-X of FIG. 12C;

FIG. 14A is a perspective view, FIG. 14B is a side view and FIG. 14C is a top view viewed from the lead side.

MODE FOR CARRYING OUT THE INVENTION

Embodiments according to the present invention will be described as examples in a case that the present invention is used to an electronic control unit (ECU) of anon-vehicle electric power steering apparatus.

Here, the electric power steering apparatus applies a rotational force of an electric motor as a steering assist force (an assist force) to a steering mechanism of the vehicle. The electric power steering apparatus applies a driving force of the motor as the steering assist force to a steering shaft or a rack shaft by means of a transmission mechanism such as gears or a belt through a reduction mechanism.

In order to accurately generate the assist torque, such an electric power steering apparatus (EPS) performs a feedback control of a motor current.

The feedback control adjusts a voltage supplied to the motor so that a difference between a steering assist command value (a current command value) and a detected motor current value becomes small, and the adjustment of the voltage applied to the motor is generally performed by an adjustment of a duty of a pulse width modulation (PWM) control.

Figure 1:
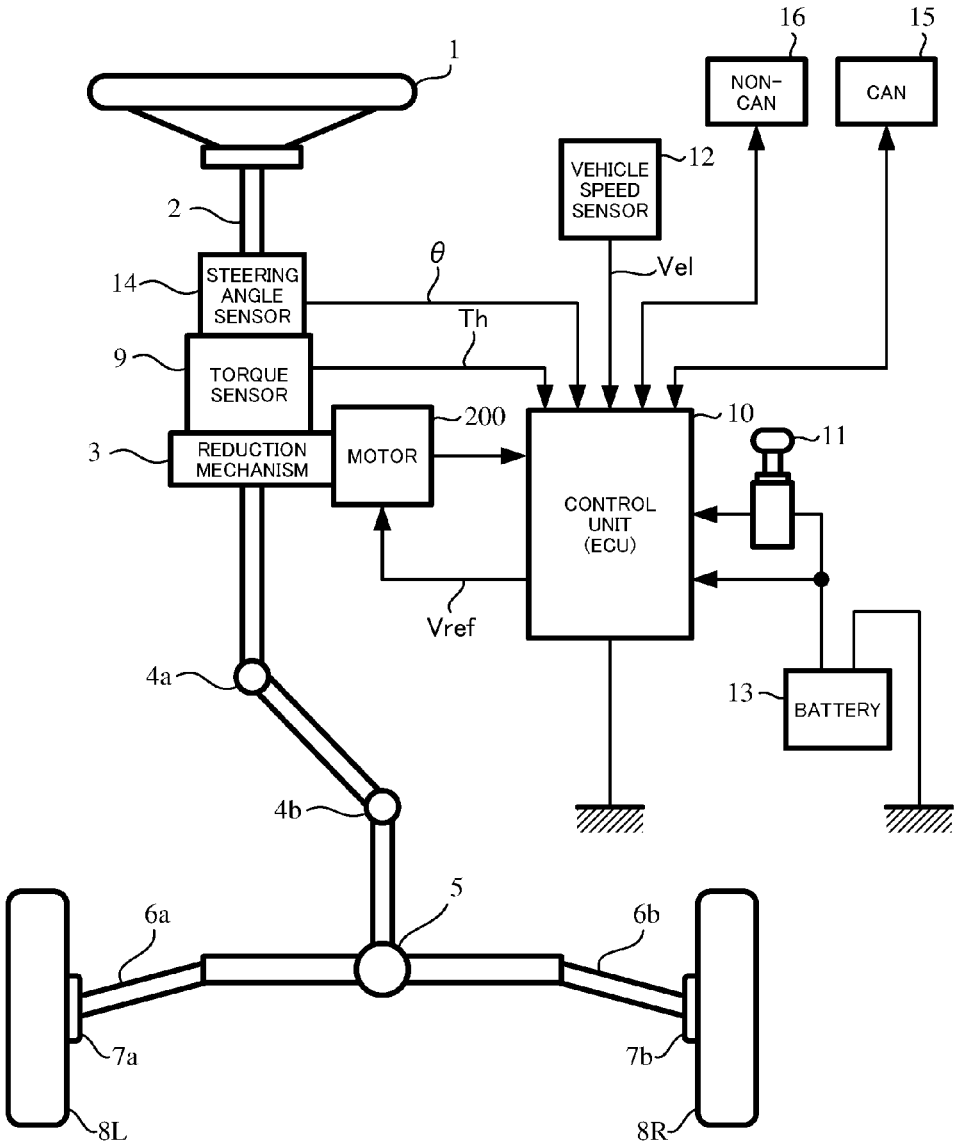
FIG. 1 is a configuration diagram illustrating a basic structure of an electric power steering apparatus that is connected to an ECU having a connector according to the present invention.

A general configuration of the conventional electric power steering apparatus will be described with reference to FIG. 1. As shown in FIG. 1, a column shaft (a steering shaft or a handle shaft) 2 connected to a steering wheel 1 is connected to steered wheels 8L and 8R through reduction gears of a reduction mechanism 3, universal joints 4*a* and 4*b*, a rack-and-pinion mechanism 5, and tie rods 6*a* and 6*b*, further via hub units 7*a* and 7*b*. In addition, the column shaft 2 is provided with a torque sensor 9 for detecting a steering torque of the steering wheel 1 and a steering angle sensor 14 for detecting a steering angle θ, and a motor 200 for assisting a steering force of the steering wheel 1 is connected to the column shaft 2 through the reduction gears (a gear ratio "n") of the reduction mechanism 3.

A control unit (ECU) 10 that is a control apparatus which controls the electric power steering apparatus comprises a micro controller unit (MCU) as a core part. The electric power is supplied to a control unit (ECU) 10 from a battery 13, and an ignition key signal is inputted into the control unit (ECU) 10 through an ignition key 11.

The control unit 10 as configured above calculates a current command value of an assist (a steering assist) command based on a steering torque Th detected by the torque sensor 9 and a vehicle speed Vel detected by a vehicle speed sensor 12, and controls a current supplied to the motor 200 by means of a voltage control value Vref obtained by performing compensation or the like to the steering assist command value. A steering angle sensor 14 is not indispensable and may not be provided. As well, it is possible to obtain the steering angle from a rotational position sensor such as a resolver which is connected to the motor 200.

Further, the controller area network (CAN) 15 to send/receive various information and signals on the vehicle is connected to the control unit 10, and it is also possible to receive the vehicle speed Vel from the CAN. Further, a Non-CAN 16 to send and receive a communication, analogue/digital signals, electric wave or the like except for the CAN 15 is also connected to the control unit 10.

Figure 2:
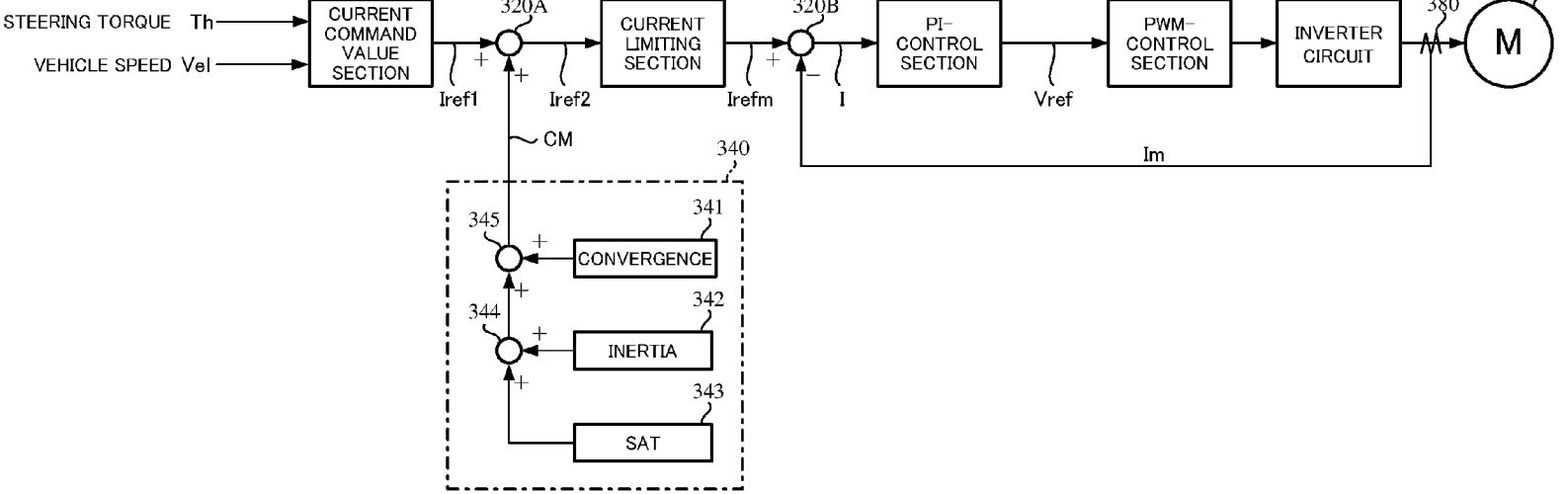
FIG. 2 is a block diagram showing a general configuration example of a control system of the electric power steering apparatus.

The control unit 10 mainly comprises a CPU (Central Processing Unit) (including an MPU (Micro Processor Unit) and an MCU), and general functions performed by programs within the CPU are shown in FIG. 2.

Functions and operations of the control unit 10 will be described with reference to FIG. 2. As shown in FIG. 2, the steering torque Th detected by the torque sensor 9 and the vehicle speed Vel detected by the vehicle speed sensor 12 (or from the CAN 15) are inputted into a current command value calculating section 310. The current command value calculating section 310 calculates a current command value Iref1, based on the steering torque Th and the vehicle speed Vel with reference to an assist map or the like, which is a control target value of a current supplied to the motor 200. The calculated current command value Iref1 is inputted into a current limiting section 330 via an adding section 320A, the current command value Irefm that is limited the maximum current in the current limiting section 330, is inputted into a subtracting section 320B. A deviation I (=Irefm−Im) between the current command value Irefm and a motor current value Im which is fed-back is calculated in the subtracting section 320B, and the deviation I is inputted into a PI (Proportional-Integral)-control section 350 for improving a current characteristic of the steering operation. The voltage control command value Vref that the characteristic is improved in the PI-control section 350, is inputted into a PWM-control section 360, and the motor 200 is PWM-driven through an inverter 370 serving as a driving section. The motor current value Im of the motor 200 is detected by a motor current detector 380 and is fed-back to the subtracting section 320B. An FET (Field-Effect Transistor) is used as a driving device in the inverter 370, and the inverter 370 is constituted by a bridge circuit of the FETs.

In addition, a compensation signal CM from a compensation signal generating section 340 is added at the adding section 320A. A characteristic compensation of the steering system is performed by adding the compensation signal CM, and then a convergence, an inertia property and so on are improved. The compensating section 340 adds a self-aligning torque (SAT) 343 with an inertia 342 at an adding section 344, further adds the result of addition performed at the adding section 344 with a convergence 341 at an adding section 345, and then outputs the result of addition performed at the adding section 345 as the compensation signal CM.

Next, the control unit 10 in which the connector according to the present invention is used will be described.

Figure 3:
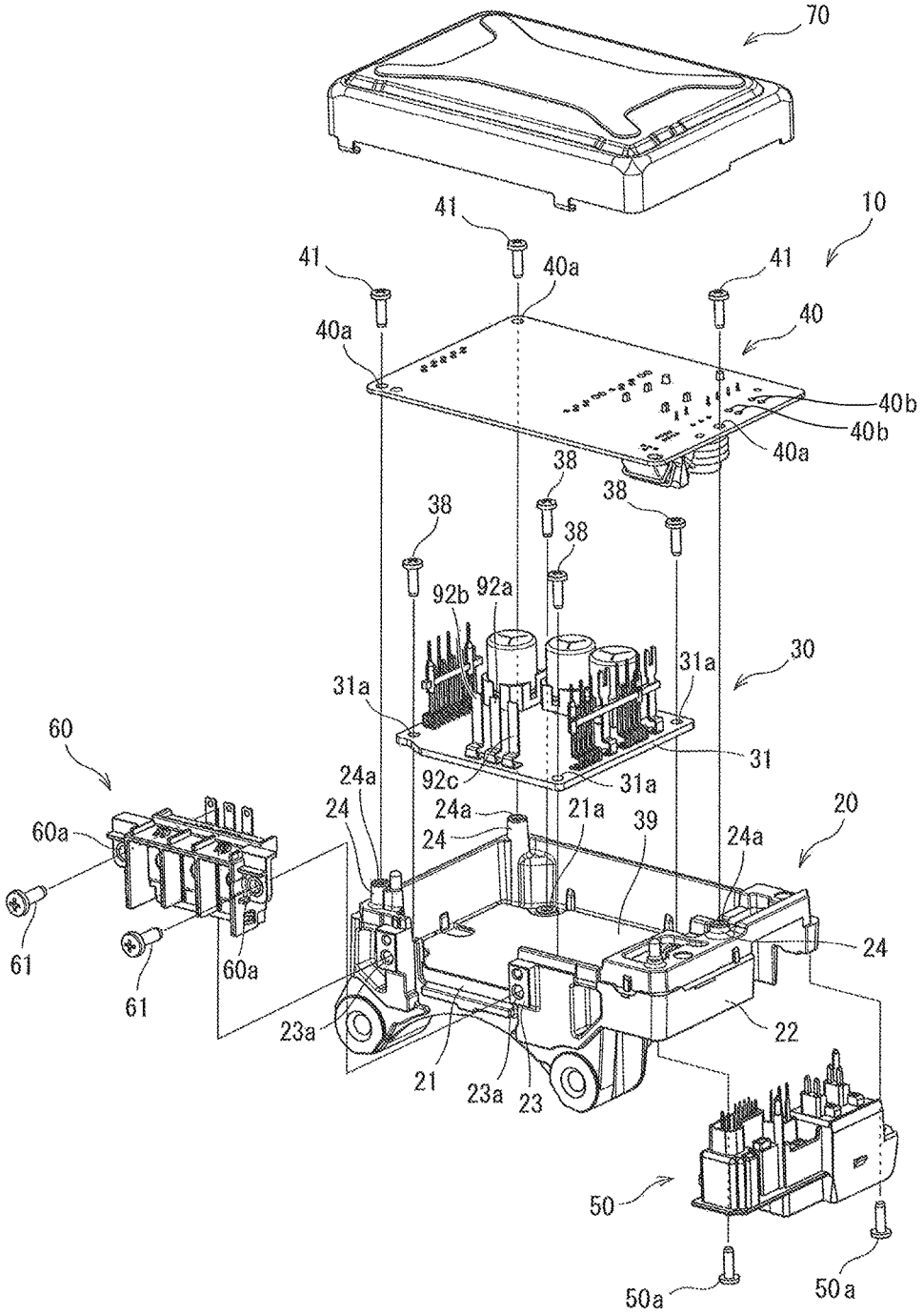
FIG. 3 is an exploded perspective view illustrating a general configuration example of the ECU that has the connector according to the present invention.

FIG. 3 is an exploded perspective view of the control unit 10 of the electric power steering apparatus shown in FIG. 1. The control unit 10 comprises a case 20, a semiconductor module 30 which includes a motor driving section as a power module, a heat dissipation sheet 39, a control circuit substrate 40 which includes a current command value calculating section and so on, a connector 50 for electric power and signal to supply the electric power and signals from an external apparatus, a three-phase output connector 60 and a cover 70.

Here, the case 20 comprises a plate-shape semiconductor module mounting section 21 to mount the semiconductor module 30, which is formed in a substantially rectangular shape; a connector implementing section 22 for electric power and signal to implement the connector 50 for electric power and signal, which is provided in a longitudinal direction end portion of the semiconductor module mounting section 21; and a three-phase output-connector implementing section 23 to implement a three-phase output connector 60, which is provided in a lateral direction end portion of the semiconductor module mounting section 21.

Then, plural screw holes 21*a* which installing screws 38 are screwed for installing the semiconductor module 30, are provided on the semiconductor module mounting section 21. On the semiconductor module mounting section 21 and the connector implement section 22 for electric power and signal, plural installing posts 24 for installing the control circuit substrate 40 are stood. Screw holes 24*a* which installing screws 41 for installing the control circuit substrate 40 are screwed, are formed on the installing posts 24. Further, plural screw holes 23*a* which installing screws 61 for installing the three-phase output connector 60 are screwed, are formed on the three-phase output-connector implementing section 23.

The semiconductor module 30 is installed on the semiconductor module mounting section 21 of the case 20 with plural installing screws 38. In a substrate 31 of the semiconductor module 30, plural through holes 31*a* in which installing screws 38 are inserted are formed.

As well, when the semiconductor module 30 is installed on the semiconductor module mounting section 21, a heat dissipation sheet 39 is mounted on the semiconductor module mounting section 21 and the semiconductor module 30 is installed on the heat dissipation sheet 39. Thus, by the heat dissipation sheet 39, the heat generated from the semiconductor module 30 is dissipated to the case 20 via the heat dissipation sheet 39.

Further, the control circuit substrate 40 comprises a control circuit, which includes a current command value calculating section and so on, by implementing plural electronic parts on the substrate. After installing the semiconductor module 30 on the semiconductor module mounting section 21, the control circuit substrate 40 is mounted on the plural installing posts 24, which is stood on the semiconductor module mounting section 21 and the connector implementing section 22 for electric power and signal from the above portion of the semiconductor module 30, by the plural installing screws 41. Plural through holes 40*a* through which installing screws 41 penetrate are formed on the control circuit substrate 40.

The connector 50 for electric power and signal is used for inputting a DC (Direct Current) power-supply from a battery (not shown) being an external apparatus into the semiconductor module 30 and inputting various signals including the signals from the torque sensor 9 and the vehicle speed sensor 12 into the control circuit substrate 40. The connector 50 for electric power and signal is installed on the connector implementing section 22 for electric power and signal, which is mounted on the semiconductor module mounting section 21, by plural installing screws 50*a*.

The three-phase output connector 60 is used for outputting currents from an a-phase output terminal 92*a*, a b-phase output terminal 92*b* and a c-phase output terminal 92*c*. The three-phase output connector 60 is installed to the three-phase output-connector implementing section 23, which is mounted on a lateral direction end portion of the semiconductor module mounting section 21, by plural installing screws 61. Plural through holes 60*a* through which installing screws 61 penetrate are formed on the three-phase output connector 60.

Furthermore, the cover 70 is installed on the case 20, which the semiconductor module 30, the control circuit substrate 40, the connector 50 for electric power and signal and the three-phase output connector 60 are installed, so as to cover the control circuit substrate 40 from above.

Next, the configuration of the connector 50 for electric power and signal which is embodiments of the present invention will be concretely described.

Figure 4:
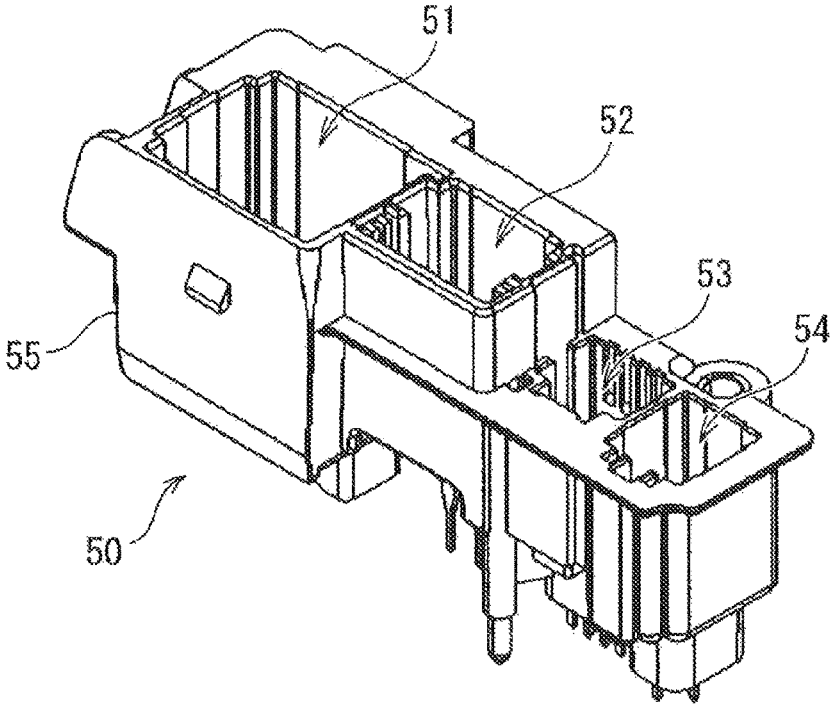
FIG. 4 is a perspective view of the connector viewed from an insertion side of an external terminal.

FIG. 4 is a perspective view of the connector 50 viewed from an insertion side to the connector (a bottom side of FIG. 3) from an external connecting apparatus. As shown in FIG. 4, the connector 50 for electric power and signal comprises a power-supply connector section 51, a communication connector section 52, a torque signal connector section 53 and a steering sensor connector section 54. Each of the connector sections has a common connector housing 55. The connector housing 55 is integrally molded by a synthetic resin which is composed of a heat conductive material.

A power-supply connector which supplies the electric power to the control unit (ECU) 10 is inserted into the power-supply connector section 51 of the connector 50, and a vehicle communication signal connector, which a CAN-communication is performed, is inserted into the communication connector section 52. A torque signal connector to input the steering torque Th from the torque sensor 9 is inserted into the torque signal connector section 53. A steering angle sensor connector to input the steering angle θ from the steering angle sensor 14 is inserted into the steering angle sensor connector section 54.

Each of the connector sections of the connector terminal is held in the connector housing 55. Noting the power-supply connector section 51, the particular structure will be described.

Figure 5:
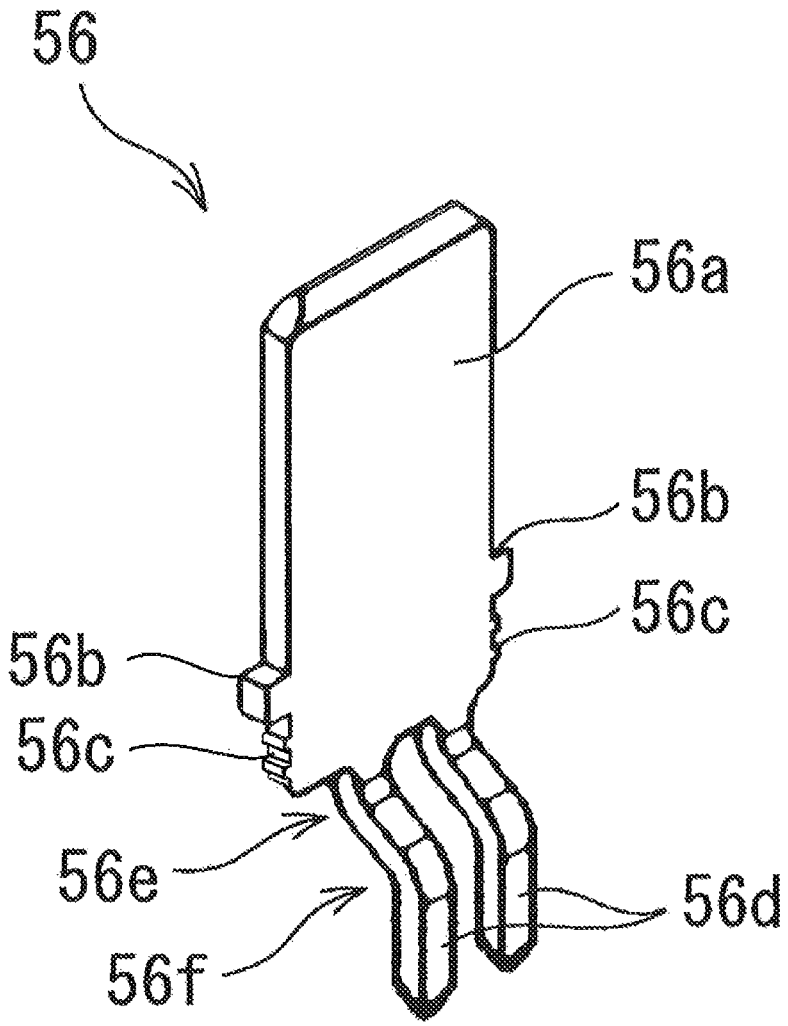
FIG. 5 is a perspective view illustrating a shape of a connector terminal.

FIG. 5 is a perspective view illustrating the power-supply connector terminal 56 which is held in the connector housing 55. In this embodiment, an upper direction in FIG. 5 is defined as an upper direction of the connector terminal 56, and a lower direction in FIG. 5 is defined as a lower direction of the connector terminal 56.

The power-supply connector terminal 56 has a plate-shape insertion section 56*a*. In a case that the connecting terminal from an external connecting equipment is inserted in the power-supply connector section 51, the insertion section 56*a* is configured by a terminal metal fitting which energizes to and is engaged with the connecting terminal. Then, stoppers 56*b* are formed on side edge portions in the vicinity of lower end portions of the insertion section 56*a*, and a press fitting sections 56*c* are formed below the stoppers 56*b* (a lower end portion of the insertion section 56*a*).

The stoppers 56*b* are protruded and are formed from end surfaces of the side edge portions of the insertion section 56*a* toward side, and the shapes of the lower surfaces of the stoppers 56*b* are planes perpendicular to the end surfaces of the side edge portions of the insertion section 56*a*.

The press fitting sections 56*c* have plural minute protrusions formed from the end surfaces of the side edge portions of the insertion section 56*a* toward side.

Figure 6A:
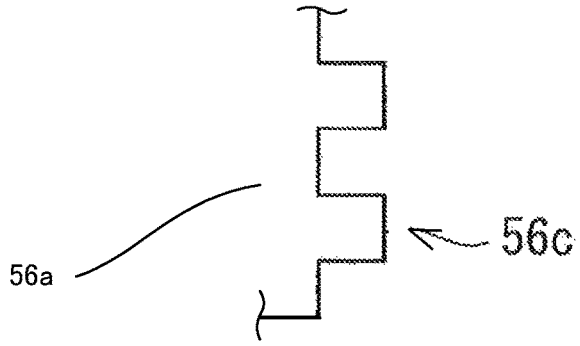
FIG. 6A, FIG. 6B and FIG. 6C are a front view illustrating an example of a form (an outline) of a press fitting portion of the connector terminal.
Figure 6B:
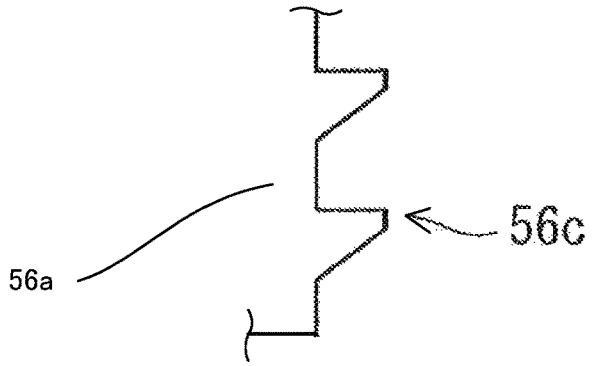
Figure 6C:
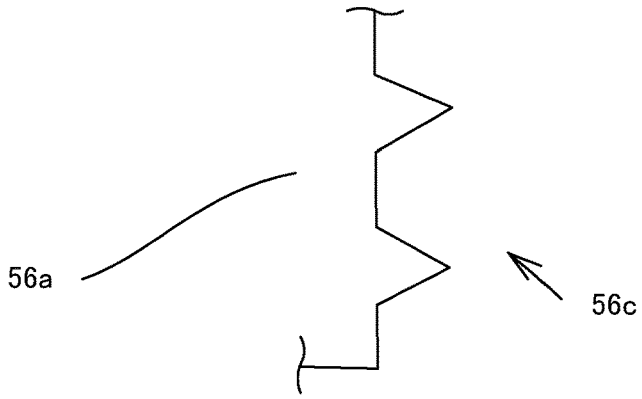

As shown in FIG. 6A, the shape of the protrusions of the press fitting section 56*c* may have rectangular-shape protrusions and recesses whose upper and lower surfaces are planes perpendicular to the end surfaces of the side edge portions of the insertion section 56*a*. Further, as shown in FIG. 6B, the shape of the protrusions of the press fitting section 56*c* may have a taper surface which the lower surface in gradual rises toward the upper direction toward side (right portion of FIG. 6B). As shown in FIG. 6C, the shape of the protrusions of the press fitting section 56*c* may have a so-called saw-tooth shape.

Further, as shown in FIG. 5, two lead sections 56*d* are connected to the lower edge portion of the insertion section 56*a* in a lateral direction, in parallel. These lead sections 56*d* have a quadrangle cross-section viewed from an extending direction. In a state that the power-supply connector terminal 56 is contained in the connector housing 55, the top end portions are inserted into the holes 40*b* which are formed on the control circuit substrate 40 as shown in FIG. 3, are soldered by a point dipping, and are performed by dust proof coating. In the above example, the cross-section of the lead section 56*d* is used to the quadrangle. However, it is not limited the above shape in the present invention, and it may be any shape that is adapted a shape-fitting which the side surface of the lead section 56*d* by incorporated with a following guide wall 57*d* forms a sealing structure with the guide wall 57*d*. The cross-section is not limited the quadrangle, it is possible to select the shapes of a circle, a polygon or the like.

The top end side of the lead section 56*d* is in parallel to a surface of the insertion section 56*a*, and is provided to the plane of the insertion section 56*a* with an offset. Particularly, the lead section 56*d* is bent to a substantially thickness direction at a position with a predetermined distance in a lower direction from the lower edge side of the insertion section 56*a* by a bending section 56*e*. Further, at a position below the bending section 56*e* with a predetermined distance, the top end of the lead section 56*d* is bent in parallel to the plate plane which configures to the insertion section 56*a* by a bending section 56*f*. That is, the lead section 56*d* is a substantially "Z"-shape viewed from the side surface of the plate. As well, angles of the bending sections 56*e* and 56*f* are an obtuse angle.

Figure 7:
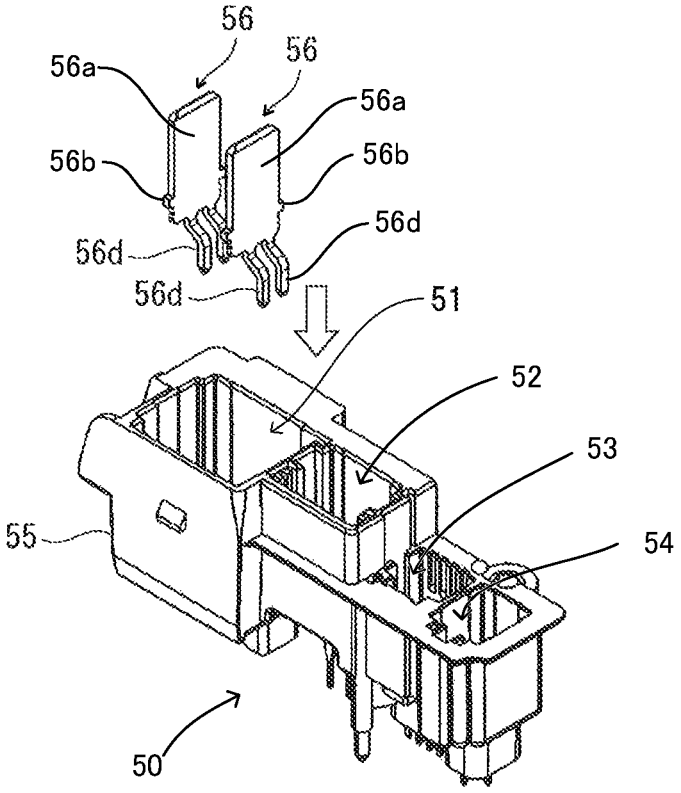
FIG. 7 is a perspective view illustrating an insertion method of the connector terminal.

As shown in FIG. 7, the power-supply connector terminals 56 are inserted into the power-supply connector sections 51 of the connector housing 55 from the lead section 56*d* side, and are held in the connector housing. (As well, a white arrow in FIG. 7 shows an insertion direction of the connector terminals 56.) Here, it is considered that the two connector terminals 56 are disposed in parallel in the thickness direction of the insertion section 56*a* and are contained in the power-supply connector section 51 of the connector housing 55. At this time, the connector terminals 56 are disposed such that the offset direction of the lead sections 56*d* is a central side of the connector housing 55 against a fixed point to the insertion section 56*a* of the lead section 56*d*. Besides, it is possible to miniaturize the installing section to the substrate of the connector by disposing the top end position of the lead sections 56*d* to the central side of connector housing 55 in this way.

Figure 8:
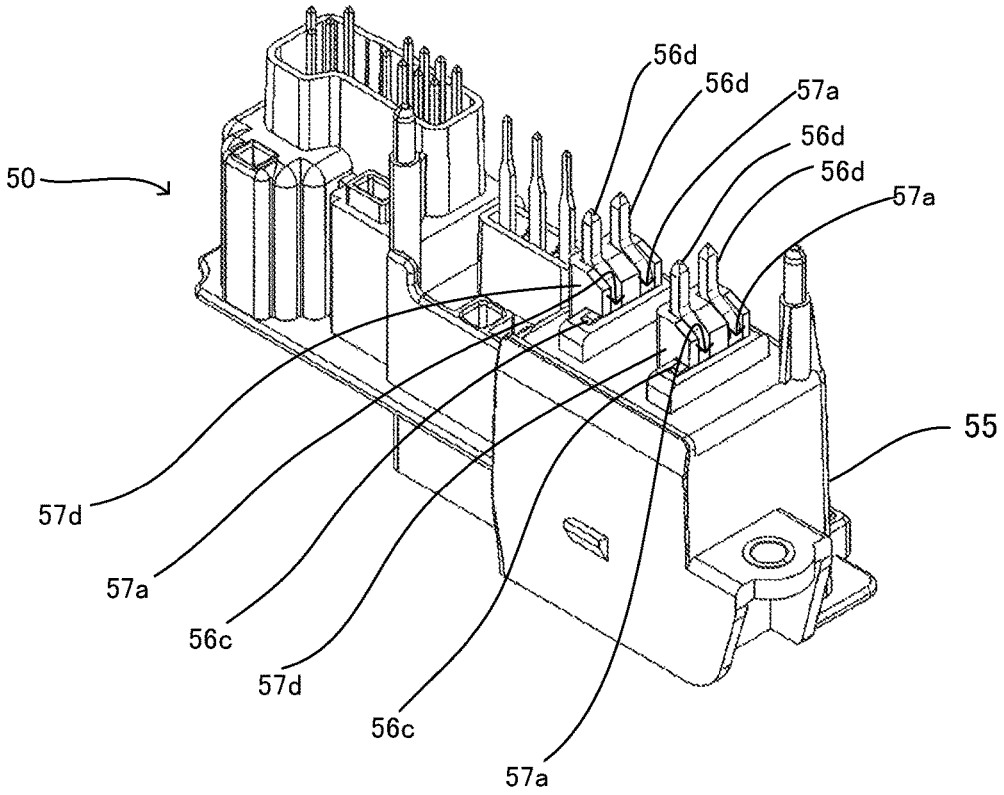
FIG. 8 is a perspective view of the connector viewed from a bottom.

FIG. 8 is a perspective view showing the connector 50 viewed from a bottom surface side of the connector housing 55 in a state that the connector terminals 56 are inserted into the connector housing 55.

As shown in FIG. 8, the connector housing 55 includes holes 57 for the two connector terminals. That is, at least power-supply connector terminal 56 has two lead sections 56*d*, and the holes 57 having two openings 57*a* that top end sides of the two lead sections 56*d* to be able to penetrate are provided in the connector housing 55. When the connector terminals 56 are contained, the lead sections 56*d* are protruded from the holes 57 in a perpendicular direction to the bottom surface of the connector housing 55.

Figure 9A:
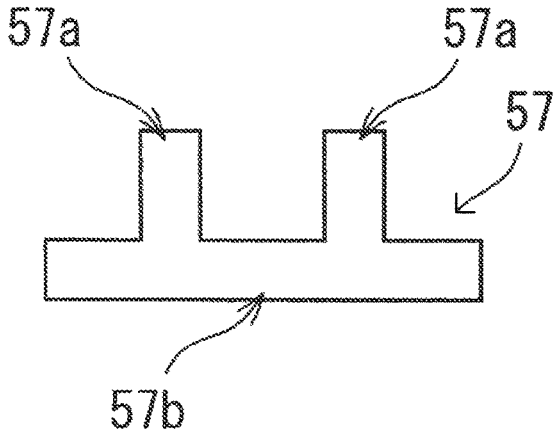
FIG. 9A is a diagram illustrating a shape of an opening viewed from an inlet and FIG. 9B is a diagram illustrating the shape of the opening viewed from an outlet.
Figure 9B:
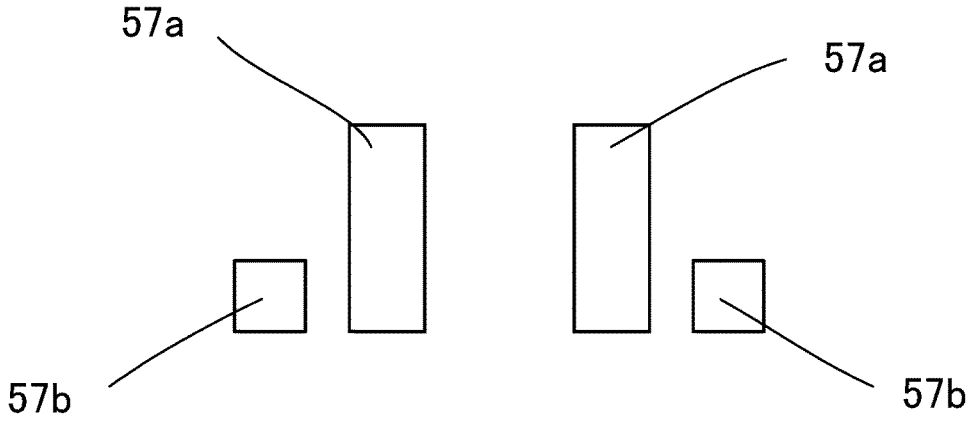

FIG. 9 is a plane view showing a shape of the holes 57. FIG. 9A shows the shape of the hole at an inlet portion of a side which press-fits the connector terminals 56, and FIG. 9B shows the shape of the holes at an outlet portion side.

As shown in FIG. 9A, the inlet portion side of the holes 57 is corresponding to a cross-sectional shape of the plane section 56*a* of the connector terminal 56 and the lead sections 56*d*, and is a hole that has a shape which two protrusions are existed in a plane view. One of the holes 57 comprises two openings (through holes) 57*a* that the lead sections 56*d* penetrate, and an opening (press fitting hole) 57*b* that the press fitting section 56*c* is press-fitted. The openings 57*a* are the same as or slightly smaller than the external form of the lead sections 56*d* when the connector terminal 56 is shown from the press fitting direction. That is, the inlet portion side of the holes 57 perfectly fits a size that the lead sections 56*d* is able to penetrate from the top end side by press fitting. As described above, the opening 57*b* is just smaller than the external form of the connector terminal 56 including the press fitting section 56*c* viewed from the press fitting direction. Accordingly, a size of an inner peripheral surface of the holes 57 is slightly smaller than that of an outer peripheral surface of the connector terminal 56.

The outlet portion side of the holes 57 is shown in FIG. 9B. Since surroundings of the two openings (through holes) that the lead sections 56*d* only penetrate are surrounded by guide wall 57*d* which is the below-described in detail, a portion of the outlet side of the opening section 57*b* which the guide wall 57*d* is existed is blocked.

Figure 10A:
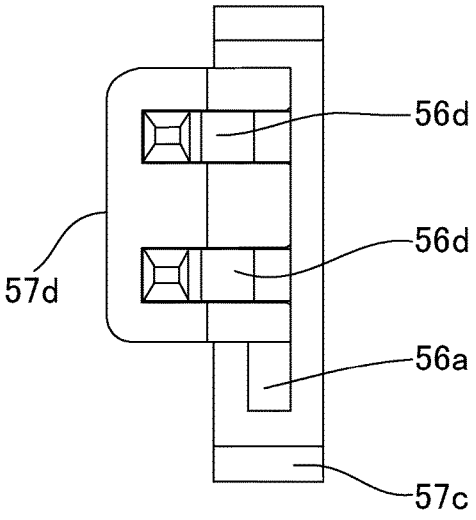
FIG. 10A to FIG. 10C are a diagram illustrating a guide wall portion neighborhood in a state that a lead section protrudes from a press fitting section to the guide section.
Figure 10B:
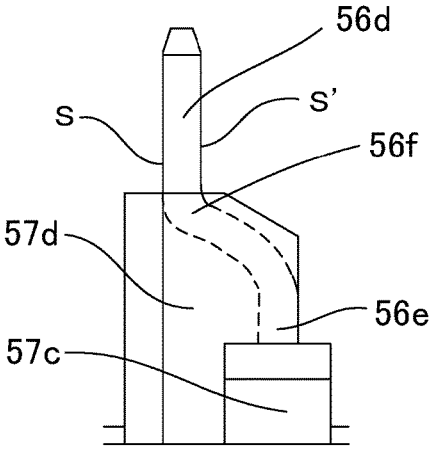
Figure 10C:
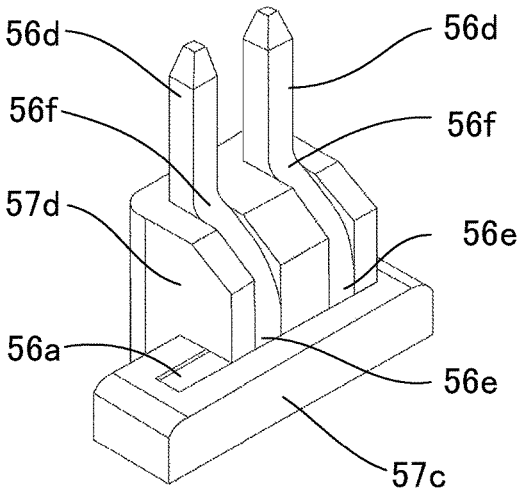

Further, in the bottom surface of the connector housing 55, the guide wall 57*d* is formed along an outer peripheral of the openings 57*a* at a side that the lead sections 56*d* only protrude during receiving the connector terminal 56 as shown in FIG. 10A to FIG. 10C (opposite side of the insertion side of the connector 50). The guide wall 57*d* is formed in at least three direction which each of the lead sections 56*d* is surrounded (left and right directions and an offset direction of the lead sections 56*d*), and its height has a distance from the outer peripheral of the outlet side of the holes 57 during receiving at least the connector terminal 56 to a position beyond the bending section 56*f* near the top end portion of the lead sections 56*d*.

FIG. 10A to FIG. 10C are a diagram illustrating the guide wall 57*d* neighborhood of the connector 50 in a state that the lead sections 56*d* protrude from the hole 57 of the press fitting section 56*c*, which has the above-described configuration, through the guide wall 57*d*. FIG. 10A is a top view, FIG. 10B is a side view and FIG. 10C is a perspective view.

As shown in FIG. 10A, the lead section 56*d* and the guide wall 57*d* are disposed such that the three side surfaces which configure to a quadrangle cross-section of the lead section 56*d* are directly in contact with the inner surface of the guide wall 57*d*. As shown in the side view of FIG. 10B, the area is extended from a press fitting end section 57*c* of the connector housing 55 that the surrounding of the press fitting section 56*c* of the connector terminal 56 is surrounded in the outlet side, to a position beyond the bending section 56*f* toward the top end portion of the lead section 56*d* of the connector terminal 56.

In both side surfaces which are parallel to a line segment connected the bending section 56*e* to the bending section 56*f* in side surfaces of the lead section 56*d*, and the inner walls of the guide wall 57*d*, an interval of the inner side surfaces of the guide 57*d* is smaller than that of the both side surfaces of the lead section 56*d*. Therefore, the guide wall 57*d* is tightly in contact with the lead section 56*d* from the outlet side of the hole 57 to the bending section 56*f* of the lead section 56*d* by press-fitting. In an opposite side surface (a surface of a back surface side of the offset direction) S to a plane of the insertion 56*a* which is perpendicular to a line segment connected to the bending sections 56*e* and 56*f* which are disposed at the offset direction of the lead section 56*d* in the side surfaces, and the inner walls of the guide wall 57*d*, the sizes of the openings 57*a* are the same as or slightly smaller than the external form of the lead section 56*d* when the connector terminal 56 is viewed from the press fitting direction. By being contacted to the surface of the back surface side of the bending section, the guide wall 57*d* is tightly in contact with a portion of the bending section 56*f* neighborhood. (The press fitting end section 57*c* is formed in protrusion from the connector housing 55. However, it is not necessary that the press fitting end section 57*c* is formed in protrusion in this way.)

Since the guide wall 57*d* has such a configuration, the guide wall 57*d* is incorporated with the side surface portion of the lead section 56*d*, and a structure that seals an interior side of the connector housing 55 from the lead section 56*d*, is adopted as shown in a perspective view of FIG. 10C.

Figure 11A:
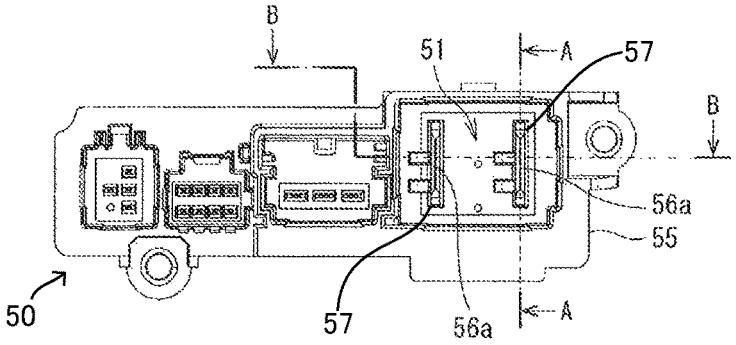
FIG. 11A to FIG. 11C are a diagram illustrating an insertion state of the connector terminal.
Figure 11B:
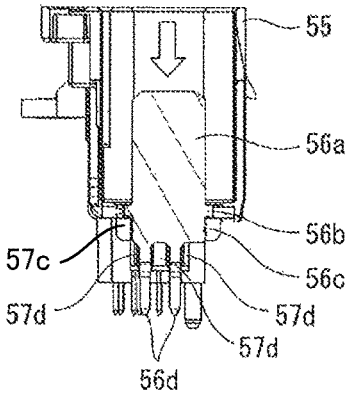
Figure 11C:
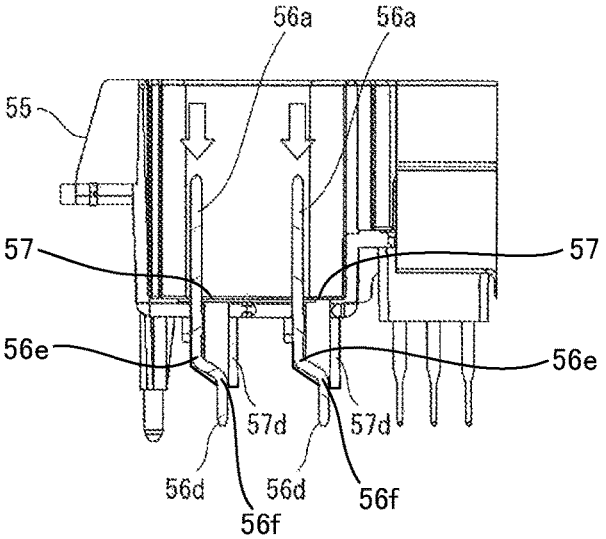

In such a configuration, when the power-supply connector terminal 56 is inserted into the power-supply connector section 51 of the connector housing 55 from the lead section 56*d* side, the insertion state of the connector terminal 56 is shown in FIG. 11A to FIG. 11C. FIG. 11A is a diagram of the connector 50 in view from an insertion side, FIG. 11B is a cross-sectional view taken along a line A-A in FIG. 11A and FIG. 11C is a cross-sectional view taken along a line B-B in FIG. 11A. Here, in FIG. 11B and FIG. 11C, the white arrows indicate the insertion direction of the connector terminal 56.

As shown in FIG. 11A to FIG. 11C, in a state that the connector terminal 56 is inserted into the hole 57 formed on the bottom surface of the connector housing 55, since a size of an inner peripheral surface of the hole 57 is slightly smaller than that of an outer peripheral surface of the connector terminal 56, the lead section 56*d* of the connector terminal 56 penetrates the openings 57*a* of the hole 57, and the press fitting sections 56*c* of the connector terminal 56 is press-fitted to the openings 57*b* of the hole 57 by a squeeze ball fitting. At this time, the protrusions of the press fitting sections 56*c* are intruded in inner walls at the vicinity of an interior of the press fitting end section 57*c*, and the connector housing 55 holds the connector terminal 56 with a sufficient holding force. Thus, it is possible to obtain a structure that it is hard to pull out the connector terminal 56 from the connector housing 55.

Since the openings 57*b* have a size that the stoppers 56*b* are impossible to penetrate, the connector terminal 56 is press-fitted into a position where the stoppers 56*b* strikes to the back side of the bottom surface of the connector housing 55. In this way, a positioning of the press fitting direction of the connector terminal 56 is performed. At this time, although it is possible to configure that bottom end surfaces of the press fitting sections 56*c* slightly protrude from the openings 57*b* as the above embodiment and are received in the press fitting end sections 57*c*, it is also possible to configure that the bottom end surfaces of the press fitting sections 56*c* do not protrude without providing the press fitting end sections 57*c*.

As shown in FIG. 11B, in this state, the guide walls 57*d* are disposed between the lead sections 56*d* such that the guide walls 57*d* are in contact with the lead sections 56*d* at the right and left sides. Further, as shown in FIG. 11C, the guide walls 57*d* are disposed at the offset side of the lead sections 56*d* against a plane of the insertion section 56*a* from the surroundings of the openings 57*a* to the bending sections 56*f* of the top end sides of the lead sections 56*d* to be tightly in contact with the lead sections 56*d* in the vicinity of at least top end portion of the bending section 56*f*.

In the present invention, the outlet sides of the openings 57*a* are blocked by the lead section 56*d* and the guide walls 57*d* so as to put on a cap. In this way, the openings 57*a* are sealed, and it is possible to prevent from entering the foreign matter from the connector insertion side to the substrate 40. Further, by constructing such a configuration, since the openings 57*a* and the opening 57*b* of the holes 57 are continuously formed from an opening of the power-supply connector section 51 which is formed opposite to the connector housing 55, a mold design of the connector housing 55 is also relatively easier.

In the guide walls 57*d*, as shown in FIG. 12A to FIG. 12D, seal lip sections 58 which stand from the peripheral of the openings in order to penetrate the lead sections 56*d* of the connector terminal 56 from the connector 50 for electric power and signal may be provided at a top end portion 57*e* of the guide walls 57*d*.

Figure 12A:
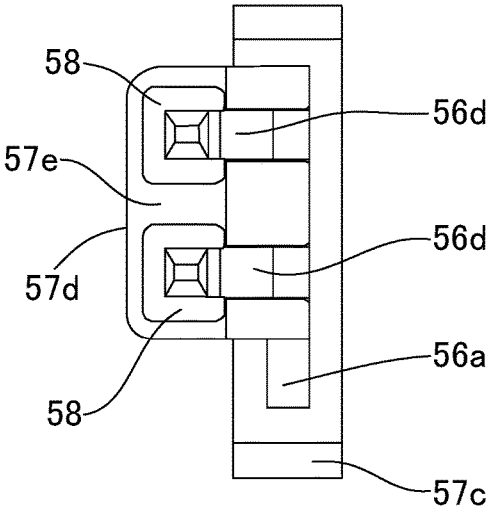
FIG. 12A to FIG. 12D area diagram illustrating an example, which a seal lip section is provided on a top end portion of the guide wall in the vicinity of the guide wall.
Figure 12B:
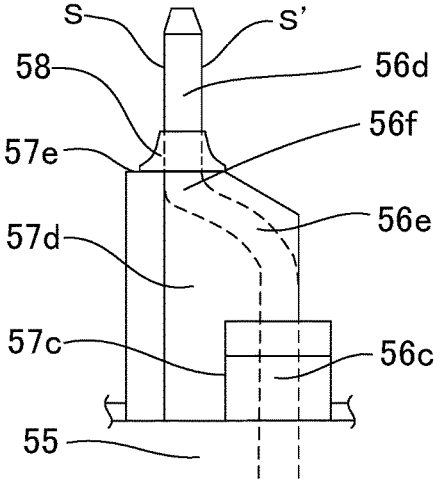
Figure 12C:
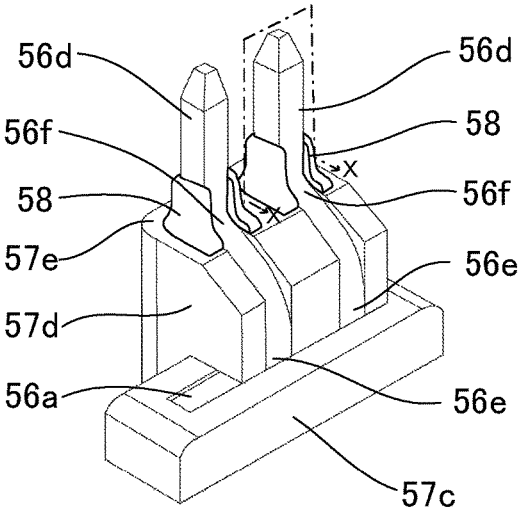
Figure 12D:
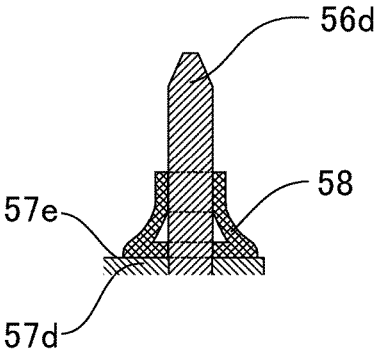

That is, FIG. 12A to FIG. 12D are diagrams illustrating an example, which is provided with the seal lip sections 58 at the top end portion 57*e* of the guide walls 57*d* in the vicinity of the guide walls 57*d* of the connector 50. FIG. 12A is a top view, FIG. 12B is a side view, FIG. 12C is a perspective view and FIG. 12D is a cross-sectional view taken along a line X-X in FIG. 12C.

The seal lip sections 58 stand from the peripheral of the openings of the top end portions 57*e* of the guide walls 57*d*, and cover three side surfaces of the lead section 56*d* protruded from the top end portion 57*e* of the guide walls 57*d* (the surface S of the back surface side to the offset direction side of the lead section 56*d* and both side surrounding surfaces) at the top end portion of the guide walls 57*d*. The seal lip sections 58 comprise a flexible synthetic resin, elastomer or the like which have an electrical insulation, a heat conductivity and flexibility. The seal lip sections 58 are attached to the three side surfaces of the lead section 56*d* and the top end portion of the guide walls 57*d*. Even if the lead section 56*d* occurs in a heat deformation, a contact surface between the lead sections 56*d* and the guide walls 57*d* is sealed to the substrate direction and it is possible to maintain a stable contact state which is tightly in contact with the side surface of the lead section 56*d*.

Here, as described above, in a case that the seal lip section 58 covers from the peripheral of the opening of the top end portion 57*e* of the guide walls 57*d* to the top end portion of the guide walls 57*d*, a size of a penetrating portion of the lead section 56*d* of the seal lip section 58 is smaller than the outer peripheral of the lead 56*d*. The seal lip may be adhered at the top end portion 57*e* of the guide walls 57*d* by using an adhesive or the like, or may be adhered by a self-fusing material such as the elastomer. Further, the material of the seal lip may be permeated from the peripheral of the opening of the top end portion 57*e* to a space of the guide wall 57*d*, and then may be stood from the peripheral of the opening.

Thus, in the present invention, the inner surface of the seal lip section 58 is tightly in contact with the side surfaces of the lead section 56*d* which protrude from the top end portion 57*e* of the guide walls 57*d*. It is possible to further improve the sealing from the connector housing 55 side to the substrate 40 in comparison with a case that the guide walls 57*d* are only provided. Since the seal lip section 58 is formed by the material such as the synthetic resin, it is possible to maintain elasticity and to keep the sealing property after the connector press-fitting.

As stated above, in the connector according to the present invention, since the openings 57*a*, which the lead section 56*d* penetrates 56*d* by the press-fitting, are disposed in the connector housing 55, it is possible to press-fit the connector terminal 56 from the lead section 56*d* side to the inserting direction of the connecting terminal from the external connecting apparatus. Hence, the connector terminal 56 which the bending process is previously performed to the lead section 56*d* is able to outsert-mold to the connector housing 55, and it is possible to relatively and easily assemble the connector 50 in the low cost.

Further, in the present embodiment, as described above, since the openings 57*a*, which the lead section 56*d* penetrates by the press-fitting, are disposed in the connector housing 55, it is possible to insert the connector terminal 56 from the lead section 56*d* side to the inserting direction of the connecting terminal from the external connecting apparatus. Thus, it is possible to prevent from the pulling out of the terminal due to the load from the connecting terminal inserting side, and the load to the substrate.

By performing the bending process to the lead section 56*d*, it is possible to reduce the stress to the substrate and the soldering portion due to the thermal contraction and the thermal expansion. Here, in a case that the connector terminal 56 is held in the connector housing 55, since the lead section 56*d* provides the bending sections 56*e* and 56*f* which are bent in two-step from the outer side of the connector housing 55 to a central direction, the top end position of the lead section 56*d* is able close to the adjacent communication connector section 52 and then the installing section to the substrate 40 of the connector 50 is compact.

Since the stoppers 56*b* are disposed on the connector terminal 56 and the stoppers 56*b* are struck when the connector terminal 56 is inserted from the connector inserting direction, it is possible to position the press fitting direction of the connector terminal 56 by the stoppers 56*b* as well as that the connector terminal 56 does not directly transmit the load toward the substrate when receiving the insertion load of the connector or a pushing force (an external force) to the connector terminal 56. Here, since the stoppers 56*b* are disposed on the side edge sections of plate-shape insertion section 56*a*, it is hard that the connector terminal 56 buckles.

Further, in the present embodiment, the press fitting sections 56*c* having the minute protrusions are disposed on the connector terminal 56, and the connector terminal 56 is press-fitted and is fixed to the connector housing 55. In this connection, it is possible to simply assemble the connector 50 in the low cost, and to suppress the pulling out of the terminal by demonstrating a sufficient holding force due to the inroad of the protrusions against the inner walls of the openings 57*b*. Especially, the press fitting sections 56*c* have a shape as shown in FIG. 6B, and the structure that the connector terminal 56 is easily press-fitted and is hardly pulled out, is obtained.

Furthermore, since the lead section 56*d* is outsert-molded to the connector housing 55 after the performance of the bending process to the lead section 56*d*, it is not necessary to prepare extra equipment performing the bending process and it is possible to improve a process precision in comparison with a case that the bending process is performed after the outsert-mold. By the lead section 56*d* being previously bent, since the stress to the resin which generates in the bending process after the outsert is reduced, an occurrence of cracks on the connector 50 is prevented. Still further, since a bending dimension and a length dimension are previously regulated and a press fitting depth of the connector terminal 56 is determined by the stoppers 56*b*, a positioning precision of the top end of the lead section is improved.

In the present invention, by forming the guide walls 57*d* mutually and tightly in contact with the side surfaces of the lead section 56*d* along an outer peripheral of the openings 57*a*, the through holes of the lead section 56*d* are sealed and the sealing structure which prevents from entering the foreign matter from the connector housing side to the substrate, is adopted. In addition to the sealing effect, since the lead section 56*d* is protected by the guide walls 57*d*, it is possible to reinforce the lead section 56*d* to a bending load input against and to prevent the falling down of the lead section 56*d*.

Thus, in the present invention, a cost reduction by a simple assembling method, a decrease of the load to the connector housing 55 and a prevention from the pulling out of the terminal when inserting the connector are realized.

Since an improvement in the positioning precision between the substrate 40 and the lead section 56*d* of the terminal 56 and a protection to the external force of the connector terminal 56*d* are realized, it is possible to simply perform the assembling of the connector 50. Further, since the prevention from entering the foreign matter in interior of the ECU through the connector housing 55 inside from the connector 50 side, it is capable of improving a reliability of the ECU.

As described above, the embodiments of the present invention are explained, and the present invention is not limited to these embodiments and various modifications and improvements can be performed.

Figure 13A:
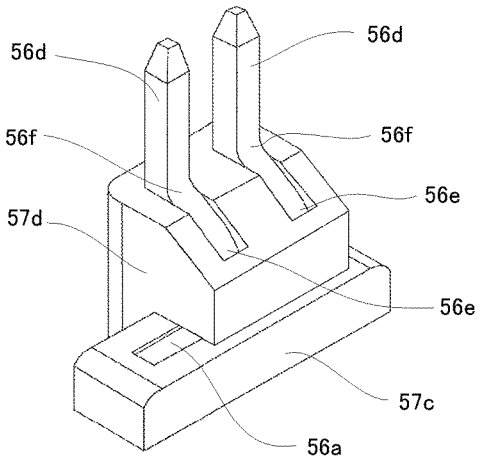
FIG. 13A to FIG. 13C are a diagram illustrating another embodiments with respect to the guide wall and a hole.
Figure 13B:
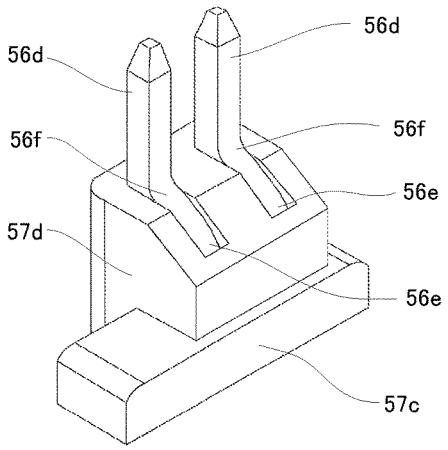
Figure 13C:
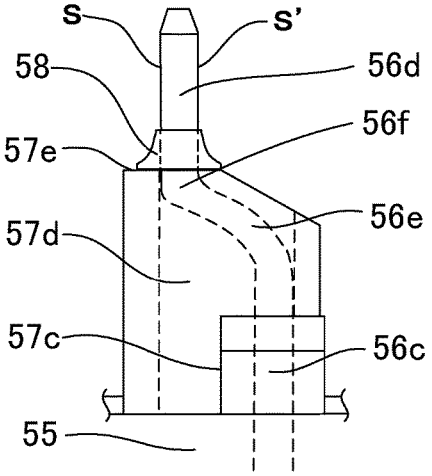

For example, in the above embodiments, the guide walls 57*d* are in contact with the three side surfaces of the lead section 56*d*. However, as shown in FIG. 13A to FIG. 13C, it is possible that the guide walls 57*d* are in contact with the four side surfaces of the lead section 56*d* (the above three side surfaces and a surface S' which is the opposite surface of the back surface side of the surface S which is the offset direction side of the lead section 56*d*). Here, FIG. 13A to FIG. 13C are diagrams illustrating another embodiments of the guide walls 57*d* and the hole 57, FIG. 13A and FIG. 13B are perspective views and FIG. 13C is a side view. As shown in FIG. 13A to FIG. 13C, the guide walls 57*d* may be in contact with four side surfaces (all of side surfaces) of the lead section 56*d* along the outer peripheral of the openings 57*a*. The fourth side surface S' as well as the other three side surfaces, fits to the lead section 56*d* in pressing. In a height of the guide walls 57*d*, as shown in FIG. 10A to FIG. 10C and FIG. 11A to FIG. 11C, heights of the above three surfaces of the four side surfaces are those of the bending section 56*f* toward the top end portion of the lead section 56*d* from the outlet side of the hole 57. A height of the other one surface may be that of the bending section 56*e* toward the opening 57*a* of the connector 50.

In the above embodiment, as shown in FIG. 9A, the shape of the inlet side of the hole 57, which is formed on the connector housing 55, has two protrusions in the plane view. As shown in FIG. 9B, the shape of the outlet side which the hole 57 is divided by the guide wall is explained. However, the opening 57*b* which the press fitting section 56*c* of the connector terminal 56 is press-fitted is blocked as shown in FIG. 13B and FIG. 13C which is aside view of the lead side, and the sealing property may further be improved.

Figure 14A:
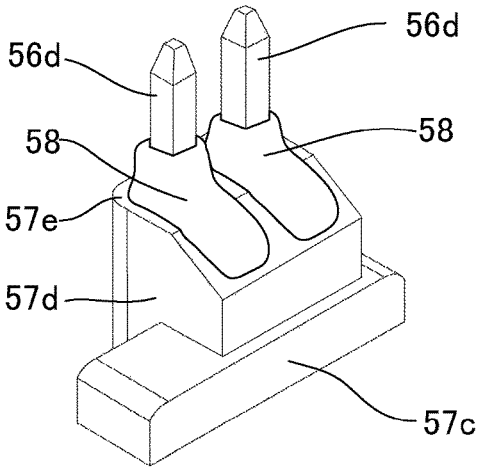
FIG. 14A to FIG. 14C are a diagram illustrating another example, which the seal lip section is provided on the top end portion of the guide wall in the vicinity of the guide wall.
Figure 14B:
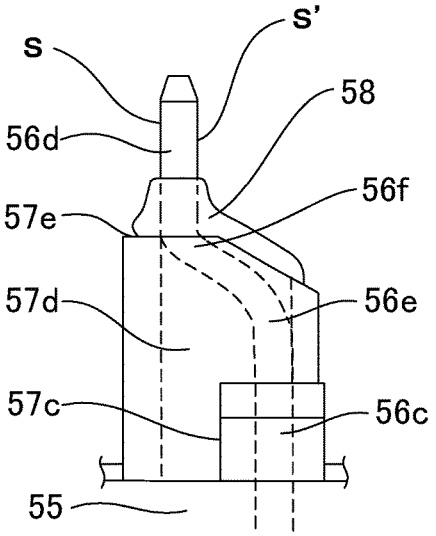
Figure 14C:
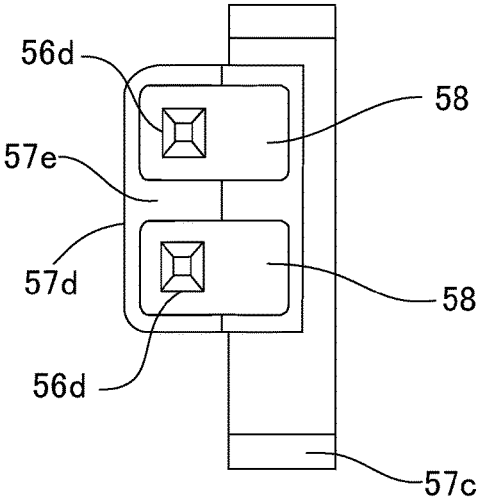

As shown in FIG. 13A, FIG. 13B and FIG. 13C, the guide wall 57*d* is extended to the bending section 56*e* in the lead section 56*d* of the insertion section 56*e* side of the connector terminal 56. In a case that the guide wall 57*d* is in contact with the four side surfaces of the lead section 56*d*, as shown in FIG. 14A to FIG. 14C, it is possible that the seal lip sections 58 is provided on the top end portion 57*e* of the guide wall 57*d*. FIG. 14A to FIG. 14C are diagrams illustrating a configuration example, which the seal lip sections 58 are provided on the top end portion 57*e* of the guide wall 57*d*, FIG. 14A is a perspective view, FIG. 14B is a side view and FIG. 14C is a top view viewed from the lead side.

As shown in FIG. 14A to FIG. 14C, particularly, the seal lip sections 58 are stood from the peripherals of the openings of the top end portion 57*e* of the guide wall 57*d*, and cover the four side surfaces of the lead sections 56*d* which are protruded from the top end portion 57*e* of the guide wall 57*d*.

In a case of adopting such a configuration, as described above, the guide wall 57*d* is in contact with the four side surfaces of the lead section 56*d* (all of side surfaces) along the outer peripheral of the openings 57*a*. It is possible that the seal lip sections 58 further cover the four overall contact surfaces and the top end portion 57*e* of the guide wall to the substrate direction. The seal lip sections comprise a flexible synthetic resin, elastomer or the like which have electrical insulation, heat conductivity and flexibility. The seal lip sections are attached to the four side surfaces of the lead section and the top end portion 57*e* of the guide wall. Even if the lead section 56*d* occurs in a heat deformation, it is possible to maintain a stable contact state which the seal lip sections are tightly in contact with the four contact surface of the top end portion 56*d*. As well as described above, in a case that the seal lip covers the four side surfaces of the lead section 56*d* which protrudes from the peripheral of the opening of the top end portion 57*e* of the guide wall 57*d*, the penetrate portion of the lead 56*d* in the seal lip portion 58 is formed smaller than the outer dimension of the lead 56*d*. The seal lip may be adhered at the top end portion 57*e* of the guide wall 57*d* by using the adhesive or the like, or may be adhered by a self-fusing material such as the elastomer. Further, the material of the seal lip may be permeated from the peripheral of the opening of the top end portion 57*e* to a space of the guide wall 57*d*, and then may be stood from the peripheral of the opening.

Then, by providing the seal lip sections 58 in such a way, it is possible that the sealing from the connector housing 55 side to the substrate 40 is further improved in a case that the guide wall 57*d* is only provided. As described above, since the seal lip sections 58 are formed from a material such as the synthetic resin, it is possible that elasticity is maintained and sealing property is kept after press-fitted the connector.

In the respective embodiments, the connector housing 55 is composed of the synthetic resin including a heat conductive material and the like. In a case that the connector housing 55 is made from such a heat conductive resin, in particular, a high heat conductive resin, by a synergy action that the lead section 56*d* of the connector terminal 56 is directly in contact with the guide wall 57*d*, heat transmission efficiency is enhanced due to the connector housing 55. Heat dissipation from the connector terminal 56 enables to be further efficiently performed via the connector housing.

In the above embodiments, a case that is applied the connector terminal 56 of the power-supply connector section 51 to the present invention is described. It is not limited to the above case, and even the connector which the connector terminal having the bending lead section is incorporated to the connector housing by using insertion press fitting can be applied to the present invention.

As described above, according to the connector in accordance with the present invention, it is possible that an assembling the connector terminal to the connector housing is simplified, the lead section protruded from the connector housing is protected and prevention from entering the foreign matter from the connector to the connector housing inside can effectively be realized. The present invention is extremely useful.

EXPLANATION OF REFERENCE NUMERALS

1 handle (steering wheel)
2 column shaft (steering shaft, handle shaft)
3 reduction mechanism
4*a*, 4*b* universal joint
5 rack-and-pinion mechanism
6*a*, 6*b* tie rod
7*a*, 7*b* hub unit
8L, 8R steered wheels
9 torque sensor
10 control unit (ECU)
11 ignition key
12 vehicle speed sensor
13 battery
14 steering angle sensor
20 case
21 semiconductor module mounting section
21*a* screw hole
22 connector implementing section for electric power and signal
23 three-phase output-connector implementing section
23*a* screw hole
24 installing post
24*a* screw hole
30 semiconductor module
31 substrate
31*a* through hole
38 installing screw
39 heat dissipation sheet
40 control circuit substrate
40*a* through hole
40*b* hole
41 installing screw
50 connector for electric power and signal
50*a* installing screw
51 power-supply connector section
52 communication connector section
53 torque signal connector section
54 steering angle sensor connector section
55 connector housing
56 power-supply connector terminal (terminal)
56*a* insertion section
56*b* stopper
56*c* press fitting section
56*d* lead section
56*e*, 56*f* bending section
57 hole
57*a* opening (through hole)
57*b* opening (press fitting hole)
57*c* press fitting end section
57*d* guide wall
57*e* guide wall top end section
58 seal lip section
60 three-phase output connector
60*a* through hole
61 installing screw
70 cover
92*a* a-phase output terminal
92*b* b-phase output terminal
92*c* c-phase output terminal

The invention claimed is:

1. A connector, comprising:

a connector terminal having an insertion section including a terminal metal fitting to electrically connect to an external connecting terminal, and a lead section that has a first end fixed to an end portion of said insertion section, has a second end connected to a substrate, and has a bent shape; and a connector housing to hold said connector terminal, wherein said connector housing comprises:

a through hole having a minimum size that said lead section to penetrate by inserting said connector terminal, which is provided with said lead section, from an insertion side of an external connecting terminal of said connector housing, and a guide wall which is formed along an outer peripheral of said through hole, and is protruded in a direction which said lead section protrudes from said connector housing, wherein said lead section has a quadrangle cross-sectional shape, said top end portion of said lead section is coincident with an inserting direction to said connector housing of said connector terminal in a holding state to said connector housing, and said lead section comprises a bending section near a top end side of said lead section and a bending section near an insertion section side of said lead section, so as to be a substantially "Z"-shape which is extended to a position which is offset to a center position of said connector housing against a fixed point to said insertion section, wherein said bending section near said insertion section side is formed to be located near said outer peripheral of said through hole of said connector housing, wherein said guide wall is provided with surrounding three surfaces of said lead section which are both side surfaces to said offset direction side of said lead section, and a surface of a back surface side to said offset direction side of said lead section, wherein said guide wall has a height which said both side surfaces disposed to said offset direction side of said lead section, are covered from said outer peripheral of said through hole to a portion from said bending section near said top end side of said lead section to said bending section near said insertion section side of said lead section, and has a height which said back surface disposed to said offset direction side of said lead section, is covered from said outer peripheral of said through hole to said bending section near said top end side of said lead section, wherein said inner walls of said guide wall are directly in contact with said side walls of said lead section, wherein a seal lip section is provided so as to stand from a peripheral of an opening of said bending portion side near said top end side of said lead section at an top end of said guide wall, and seals by covering said three side surfaces of said lead section near an top end of said guide wall, which are protruded from said top end of said guide wall, and are both side surfaces to said offset direction side of said lead section, and a surface of said back surface side to said offset direction side of said lead section, and wherein said seal lip section forms a sealing structure from said bending sections of said lead section to an interior of said connector housing by attaching said three side surfaces of said lead section to said top end of said guide wall by using a flexible synthetic resin or elastomer, which has electrical insulation, heat conductivity and flexibility, and an adhesive or by using a self-fusing material, which has electrical insulation, heat conductivity and flexibility.

2. The connector according to claim 1, wherein said connector housing includes a press fitting hole which said connector terminal is press-fitted, and said insertion section includes a press fitting section that press-fits said fixed end side of said lead section into said press fitting hole.

3. The connector according to claim 2, wherein said press fitting section includes minute protrusions which protrude from side end sections of said insertion section to side directions.

4. The connector according to claim 3, wherein said insertion section is provided adjacent to said press fitting section opposed to said fixed side of said lead section, and comprises stoppers which protrude from an outer peripheral of said press fitting hole to a side direction.

5. The connector according to claim 1, wherein said terminal metal fitting is a connecting terminal which is used for power-supply and has a flat plate shape.

6. The connector according to claim 1, wherein said connector housing is made by a heat conductive resin.

7. A connector, comprising:

a connector terminal having an insertion section including a terminal metal fitting to electrically connect to an external connecting terminal, and a lead section that has a first end fixed to an end portion of said insertion section, has a second end connected to a substrate, and has a bent shape; and a connector housing to hold said connector terminal, wherein said connector housing comprises:

a through hole having a minimum size that said lead section can penetrate by inserting said connector terminal, which is provided with said lead section, from an insertion side of an external connecting terminal of said connector housing, and a guide wall which is formed along an outer peripheral of said through hole, and is protruded in a direction which said lead section protrudes from said connector housing, wherein said lead section has a quadrangle cross-sectional shape, said top end portion of said lead section is coincident with an inserting direction to said connector housing of said connector terminal in a holding state to said connector housing, and said lead section comprises a bending section near a top end side of said lead section and a bending section near an insertion section side of said lead section, so as to be a substantially "Z"-shape which is extended to a position which is offset to a center position of said connector housing against a fixed point to said insertion section, wherein said bending section near said insertion section side is formed to be located near said outer peripheral of said through hole of said connector housing, wherein said guide wall is provided with surrounding four surfaces of said lead section which are both side surfaces to said offset direction side of said lead section, a surface of a back surface side to said offset direction side of said lead section, and a front surface to said offset direction side of lead section, wherein said guide wall has a height which said both side surfaces disposed to said offset direction side of said lead section, are covered from said outer peripheral of said through hole to a portion from said bending section near said top end side of said lead section to said bending section near said insertion section side of said lead section, has a height which said back surface disposed to said offset direction side of said lead section, is covered from said outer peripheral of said through hole to said bending section near said top end side of said lead section, and has a height which said front surface disposed to said offset direction side of said lead section, is covered from said outer peripheral of said through hole to said bending section near said insertion section side of said lead section, wherein said inner walls of said guide wall are directly in contact with said side walls of said lead section, wherein a seal lip section is provided so as to stand from a peripheral of an opening of said bending portion side near said top end side of said lead section at an top end of said guide wall, and seals by covering said three side surfaces of said lead section near an top end of said guide wall, which are protruded from said top end of said guide wall, and are both side surfaces to said offset direction side of said lead section, and a surface of said back surface side to said offset direction side of said lead section, and wherein said seal lip section forms a sealing structure from said bending sections of said lead section to an interior of said connector housing by attaching said three side surfaces of said lead section to said top end of said guide wall by using a flexible synthetic resin or elastomer, which has electrical insulation, heat conductivity and flexibility, and an adhesive or by using a self-fusing material, which has electrical insulation, heat conductivity and flexibility.

8. The connector according to claim 7, wherein said connector housing includes a press fitting hole which said connector terminal is press-fitted, and said insertion section includes a press fitting section that press-fits said fixed end side of said lead section into said press fitting hole.

9. The connector according to claim 8, wherein said press fitting section includes minute protrusions which protrude from side end sections of said insertion section to side directions.

10. The connector according to claim 9, wherein said insertion section is provided adjacent to said press fitting section opposed to said fixed side of said lead section, and comprises stoppers which protrude from an outer peripheral of said press fitting hole to a side direction.

11. The connector according to claim 7, wherein said terminal metal fitting is a connecting terminal which is used for power-supply and has a flat plate shape.

12. The connector according to claim 7, wherein said connector housing is made by a heat conductive resin.

13. A connector, comprising:

a connector terminal having an insertion section including a terminal metal fitting to electrically connect to an external connecting terminal, and a lead section that has a first end fixed to an end portion of said insertion section, has a second end connected to a substrate, and has a bent shape; and a connector housing to hold said connector terminal, wherein said connector housing comprises:

a through hole having a minimum size that said lead section can penetrate by inserting said connector terminal, which is provided with said lead section, from an insertion side of an external connecting terminal of said connector housing, and a guide wall which is formed along an outer peripheral of said through hole, and is protruded in a direction which said lead section protrudes from said connector housing, wherein said lead section has a quadrangle cross-sectional shape, said top end portion of said lead section is coincident with an inserting direction to said connector housing of said connector terminal in a holding state to said connector housing, and said lead section comprises a bending section near a top end side of said lead section and a bending section near an insertion section side of said lead section, so as to be a substantially "Z"-shape which is extended to a position which is offset to a center position of said connector housing against a fixed point to said insertion section, wherein said bending section near said insertion section side is formed to be located near said outer peripheral of said through hole of said connector housing, wherein said guide wall is provided with surrounding four surfaces of said lead section which are both side surfaces to said offset direction side of said lead section, a surface of a back surface side to said offset direction side of said lead section, and a front surface to said offset direction side of lead section, wherein said guide wall has a height which said both side surfaces disposed to said offset direction side of said lead section, are covered from said outer peripheral of said through hole to a portion from said bending section near said top end side of said lead section to said bending section near said insertion section side of said lead section, has a height which said back surface disposed to said offset direction side of said lead section, is covered from said outer peripheral of said through hole to said bending section near said top end side of said lead section, and has a height which said front surface disposed to said offset direction side of said lead section, is covered from said outer peripheral of said through hole to said bending section near said insertion section side of said lead section, wherein said inner walls of said guide wall are directly in contact with said side walls of said lead section, wherein a seal lip section is provided so as to stand from a peripheral of an opening of said bending portion side near said top end side of said lead section at an top end of said guide wall, and seals by covering said four side surfaces of said lead section near an top end of said guide wall, which are protruded from said top end of said guide wall, and wherein said seal lip section forms a sealing structure from said bending sections of said lead section to an interior of said connector housing by attaching said three side surfaces of said lead section to said top end of said guide wall by using a flexible synthetic resin or elastomer, which has electrical insulation, heat conductivity and flexibility, and an adhesive or by using a self-fusing material, which has electrical insulation, heat conductivity and flexibility.

14. The connector according to claim 13, wherein said connector housing includes a press fitting hole which said connector terminal is press-fitted, and said insertion section includes a press fitting section that press-fits said fixed end side of said lead section into said press fitting hole.

15. The connector according to claim 14, wherein said press fitting section includes minute protrusions which protrude from side end sections of said insertion section to side directions.

16. The connector according to claim 15, wherein said insertion section is provided adjacent to said press fitting section opposed to said fixed side of said lead section, and comprises stoppers which protrude from an outer peripheral of said press fitting hole to a side direction.

17. The connector according to claim 13, wherein said terminal metal fitting is a connecting terminal which is used for power-supply and has a flat plate shape.

18. The connector according to claim 13, wherein said connector housing is made by a heat conductive resin.

* * * * *